US007451826B2

(12) United States Patent
Pietras

(10) Patent No.: US 7,451,826 B2
(45) **Date of Patent: *Nov. 18, 2008**

(54) APPARATUS FOR CONNECTING TUBULARS USING A TOP DRIVE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/464,575

(22) Filed: Aug. 15, 2006

(65) Prior Publication Data

US 2007/0051519 A1 Mar. 8, 2007

Related U.S. Application Data

(63) Continuation of application No. 10/801,289, filed on Mar. 16, 2004, now Pat. No. 7,090,021, which is a continuation of application No. 09/762,606, filed as application No. PCT/GB99/02708 on Aug. 16, 1999, now Pat. No. 6,705,405.

(30) Foreign Application Priority Data

Aug. 24, 1998 (GB) ..... 9818360.1

(51) Int. Cl.
*E21B 19/00* (2006.01)

(52) U.S. Cl. ..... 166/380; 166/85.1; 166/85.5; 166/77.51

(58) Field of Classification Search ..... 166/85.5, 166/77.51, 85.1, 380, 75.14; 175/203, 85, 175/162, 220

See application file for complete search history.

(56) References Cited

U.S. PATENT DOCUMENTS 179,973 A 7/1876 Thornton
1,414,207 A 4/1922 Reed (Continued)

FOREIGN PATENT DOCUMENTS

CA 2 307 386 11/2000

(Continued)

OTHER PUBLICATIONS

"First Success with Casing-Drilling" Word Oil, Feb. (1999), pp. 25.

(Continued)

*Primary Examiner*—Jennifer H Gay
*Assistant Examiner*—Daniel Stephenson
(74) *Attorney, Agent, or Firm*—Patterson & Sheridan, LLP

(57) ABSTRACT

An apparatus for facilitating the connection of tubulars using a top drive, said apparatus comprising a motor (4, 4') for rotating a tool (30) for drivingly engaging a tubular, and means (3) for connecting said motor (4, 4') to said top drive, the apparatus being such that, in use, said motor (4, 4') can rotate one tubular with respect to another to connect said tubular.

23 Claims, 2 Drawing Sheets

U.S. PATENT DOCUMENTS

| | | | |
|---|---|---|---|
| 1,418,766 | A | 6/1922 | Wilson |
| 1,585,069 | A | 5/1926 | Youle |
| 1,728,136 | A | 9/1929 | Power |
| 1,777,592 | A | 10/1930 | Thomas |
| 1,805,007 | A | 5/1931 | Pedley |
| 1,825,026 | A | 9/1931 | Thomas |
| 1,842,638 | A | 1/1932 | Wigle |
| 1,917,135 | A | 7/1933 | Littell |
| 2,105,885 | A | 1/1938 | Hinderliter |
| 2,128,430 | A | 8/1938 | Pryor |
| 2,167,338 | A | 7/1939 | Murcell |
| 2,184,681 | A | 12/1939 | Osmun et al. |
| 2,214,429 | A | 9/1940 | Miller |
| 2,414,719 | A | 1/1947 | Cloud |
| 2,522,444 | A | 9/1950 | Grable |
| 2,536,458 | A | 1/1951 | Munsinger |
| 2,570,080 | A | 10/1951 | Stone |
| 2,582,987 | A | 1/1952 | Hagenbook |
| 2,595,902 | A | 5/1952 | Stone |
| 2,610,690 | A | 9/1952 | Beatty |
| 2,641,444 | A | 6/1953 | Moon |
| 2,668,689 | A | 2/1954 | Cormany |
| 2,692,059 | A | 10/1954 | Boiling, Jr. |
| 2,953,406 | A | 9/1960 | Young |
| 2,965,177 | A | 12/1960 | Bus, Sr. et al. |
| 3,041,901 | A | 7/1962 | Knights |
| 3,087,546 | A | 4/1963 | Wooley |
| 3,122,811 | A | 3/1964 | Gilreath |
| 3,191,683 | A | 6/1965 | Alexander |
| 3,193,116 | A | 7/1965 | Kenneday et al. |
| 3,266,582 | A | 8/1966 | Homanick |
| 3,305,021 | A | 2/1967 | Lebourg |
| 3,321,018 | A | 5/1967 | McGill |
| 3,380,528 | A | 4/1968 | Timmons |
| 3,392,609 | A | 7/1968 | Bartos |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,566,505 | A | 3/1971 | Martin |
| 3,570,598 | A | 3/1971 | Johnson |
| 3,602,302 | A | 8/1971 | Kluth |
| 3,608,664 | A | 9/1971 | Weiner |
| 3,635,105 | A | 1/1972 | Dickmann et al. |
| 3,638,989 | A | 2/1972 | Sandquist |
| 3,662,842 | A | 5/1972 | Bromell |
| 3,680,412 | A | 8/1972 | Mayer et al. |
| 3,691,825 | A | 9/1972 | Dyer |
| 3,697,113 | A | 10/1972 | Palauro et al. |
| 3,700,048 | A | 10/1972 | Desmoulins |
| 3,706,347 | A | 12/1972 | Brown |
| 3,746,330 | A | 7/1973 | Taciuk |
| 3,747,675 | A | 7/1973 | Brown |
| 3,766,991 | A | 10/1973 | Brown |
| 3,776,320 | A | 12/1973 | Brown |
| 3,780,883 | A | 12/1973 | Brown |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,871,618 | A | 3/1975 | Funk |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,915,244 | A | 10/1975 | Brown |
| 3,961,399 | A | 6/1976 | Boyadjieff |
| 3,964,552 | A | 6/1976 | Slator |
| 3,980,143 | A | 9/1976 | Swartz et al. |
| 4,054,332 | A | 10/1977 | Bryan, Jr. |
| 4,077,525 | A | 3/1978 | Callegari et al. |
| 4,100,968 | A | 7/1978 | Delano |
| 4,127,927 | A | 12/1978 | Hauk et al. |
| 4,142,739 | A | 3/1979 | Billingsley |
| 4,202,225 | A | 5/1980 | Sheldon et al. |
| 4,221,269 | A | 9/1980 | Hudson |
| 4,257,442 | A | 3/1981 | Claycomb |
| 4,262,693 | A | 4/1981 | Giebeler |
| 4,274,777 | A | 6/1981 | Scaggs |
| 4,274,778 | A | 6/1981 | Putnam et al. |
| 4,280,380 | A | 7/1981 | Eshghy |
| 4,315,553 | A | 2/1982 | Stallings |
| 4,320,915 | A | 3/1982 | Abbott et al. |
| 4,401,000 | A | 8/1983 | Kinzbach |
| 4,437,363 | A | 3/1984 | Haynes |
| 4,440,220 | A | 4/1984 | McArthur |
| 4,446,745 | A | 5/1984 | Stone et al. |
| 4,449,596 | A | 5/1984 | Boyadjieff |
| 4,472,002 | A | 9/1984 | Beney et al. |
| 4,489,794 | A | 12/1984 | Boyadjieff |
| 4,492,134 | A | 1/1985 | Reinhldt et al. |
| 4,494,424 | A | 1/1985 | Bates |
| 4,515,045 | A | 5/1985 | Gnatchenko et al. |
| 4,529,045 | A | 7/1985 | Boyadjieff et al. |
| 4,570,706 | A | 2/1986 | Pugnet |
| 4,592,125 | A | 6/1986 | Skene |
| 4,593,584 | A | 6/1986 | Neves |
| 4,593,773 | A | 6/1986 | Skeie |
| 4,604,724 | A | 8/1986 | Shaginian et al. |
| 4,604,818 | A | 8/1986 | Inoue |
| 4,605,077 | A | 8/1986 | Boyadjieff |
| 4,613,161 | A | 9/1986 | Brisco |
| 4,625,796 | A | 12/1986 | Boyadjieff |
| 4,646,827 | A | 3/1987 | Cobb |
| 4,649,777 | A | 3/1987 | Buck |
| 4,652,195 | A | 3/1987 | McArthur |
| 4,667,752 | A | 5/1987 | Berry et al. |
| 4,676,312 | A | 6/1987 | Mosing et al. |
| 4,681,158 | A | 7/1987 | Pennison |
| 4,681,162 | A | 7/1987 | Boyd |
| 4,683,962 | A | 8/1987 | True |
| 4,686,873 | A | 8/1987 | Lang et al. |
| 4,709,599 | A | 12/1987 | Buck |
| 4,709,766 | A | 12/1987 | Boyadjieff |
| 4,725,179 | A | 2/1988 | Woolslayer et al. |
| 4,735,270 | A | 4/1988 | Fenyvesi |
| 4,738,145 | A | 4/1988 | Vincent et al. |
| 4,742,876 | A | 5/1988 | Barthelemy et al. |
| 4,759,239 | A | 7/1988 | Hamilton et al. |
| 4,762,187 | A | 8/1988 | Haney |
| 4,765,401 | A | 8/1988 | Boyadjieff |
| 4,765,416 | A | 8/1988 | Bjerking et al. |
| 4,773,689 | A | 9/1988 | Wolters |
| 4,781,359 | A | 11/1988 | Matus |
| 4,791,997 | A | 12/1988 | Krasnov |
| 4,793,422 | A | 12/1988 | Krasnov |
| 4,800,968 | A | 1/1989 | Shaw et al. |
| 4,813,493 | A | 3/1989 | Shaw et al. |
| 4,813,495 | A | 3/1989 | Leach |
| 4,821,814 | A | 4/1989 | Willis et al. |
| 4,832,552 | A | 5/1989 | Skelly |
| 4,836,064 | A | 6/1989 | Slator |
| 4,843,945 | A | 7/1989 | Dinsdale |
| 4,867,236 | A | 9/1989 | Haney et al. |
| 4,875,530 | A | 10/1989 | Frink et al. |
| 4,878,546 | A | 11/1989 | Shaw et al. |
| 4,899,816 | A | 2/1990 | Mine |
| 4,909,741 | A | 3/1990 | Schasteen et al. |
| 4,921,386 | A | 5/1990 | McArthur |

4,936,382 A 6/1990 Thomas
4,962,579 A 10/1990 Moyer et al.
4,962,819 A 10/1990 Bailey et al.
4,971,146 A 11/1990 Terrell
4,997,042 A 3/1991 Jordan et al.
5,022,472 A 6/1991 Bailey et al.
5,036,927 A 8/1991 Willis
5,049,020 A 9/1991 McArthur
5,060,542 A 10/1991 Hauk
5,062,756 A 11/1991 McArthur et al.
5,107,940 A 4/1992 Berry
5,111,893 A 5/1992 Kvello-Aune
RE34,063 E 9/1992 Vincent et al.
5,191,939 A 3/1993 Stokley
5,207,128 A 5/1993 Albright
5,233,742 A 8/1993 Gray et al.
5,245,265 A 9/1993 Clay
5,251,709 A 10/1993 Richardson
5,255,751 A 10/1993 Stogner
5,272,925 A 12/1993 Henneuse et al.
5,282,653 A 2/1994 LaFleur et al.
5,284,210 A 2/1994 Helms et al.
5,294,228 A 3/1994 Willis et al.
5,297,833 A 3/1994 Willis et al.
5,305,839 A 4/1994 Kalsi et al.
5,332,043 A 7/1994 Ferguson
5,340,182 A 8/1994 Busink et al.
5,351,767 A 10/1994 Stogner et al.
5,354,150 A 10/1994 Canales
5,368,113 A 11/1994 Schulze-Beckinghausen
5,386,746 A 2/1995 Hauk
5,388,651 A 2/1995 Berry
5,433,279 A 7/1995 Tessari et al.
5,461,905 A 10/1995 Penisson
5,497,840 A 3/1996 Hudson
5,501,280 A 3/1996 Brisco
5,501,286 A 3/1996 Berry
5,503,234 A 4/1996 Clanton
5,535,824 A 7/1996 Hudson
5,575,344 A 11/1996 Wireman
5,577,566 A 11/1996 Albright et al.
5,584,343 A 12/1996 Coone
5,588,916 A 12/1996 Moore
5,645,131 A 7/1997 Trevisani
5,661,888 A 9/1997 Hanslik
5,667,026 A 9/1997 Lorenz et al.
5,706,894 A 1/1998 Hawkins, III
5,711,382 A 1/1998 Hansen et al.
5,735,348 A 4/1998 Hawkins, III
5,735,351 A 4/1998 Helms
5,746,276 A 5/1998 Stuart
5,765,638 A 6/1998 Taylor
5,772,514 A 6/1998 Moore
5,785,132 A 7/1998 Richardson et al.
5,791,410 A 8/1998 Castille et al.
5,803,191 A 9/1998 Mackintosh
5,806,589 A 9/1998 Lang
5,833,002 A 11/1998 Holcombe
5,836,395 A 11/1998 Budde
5,839,330 A 11/1998 Stokka
5,842,530 A 12/1998 Smith et al.
5,850,877 A 12/1998 Albright et al.
5,890,549 A 4/1999 Sprehe
5,909,768 A 6/1999 Castille et al.
5,931,231 A 8/1999 Mock
5,960,881 A 10/1999 Allamon et al.
5,971,079 A 10/1999 Mullins
5,971,086 A 10/1999 Bee et al.
6,000,472 A 12/1999 Albright et al.
6,012,529 A 1/2000 Mikolajczyk et al.
6,056,060 A 5/2000 Abrahamsen et al.
6,065,550 A 5/2000 Gardes
6,070,500 A 6/2000 Dlask et al.
6,079,509 A 6/2000 Bee et al.
6,119,772 A 9/2000 Pruet
6,142,545 A 11/2000 Penman et al.
6,161,617 A 12/2000 Gjedebo
6,170,573 B1 1/2001 Brunet et al.
6,173,777 B1 1/2001 Mullins
6,199,641 B1 3/2001 Downie et al.
6,202,764 B1 3/2001 Ables et al.
6,217,258 B1 4/2001 Yamamoto et al.
6,227,587 B1 5/2001 Terral
6,237,684 B1 5/2001 Bouligny, Jr. et al.
6,276,450 B1 8/2001 Seneviratne
6,279,654 B1 8/2001 Mosing et al.
6,309,002 B1 10/2001 Bouligny
6,311,792 B1 11/2001 Scott et al.
6,315,051 B1 11/2001 Ayling
6,334,376 B1 1/2002 Torres
6,349,764 B1 2/2002 Adams et al.
6,360,633 B2 3/2002 Pietras
6,378,630 B1 4/2002 Ritorto et al.
6,390,190 B2 5/2002 Mullins
6,412,554 B1 7/2002 Allen et al.
6,415,862 B1 7/2002 Mullins
6,431,626 B1 8/2002 Bouligny
6,443,241 B1 9/2002 Juhasz et al.
6,527,047 B1 3/2003 Pietras
6,527,493 B1 3/2003 Kamphorst et al.
6,536,520 B1 3/2003 Snider et al.
6,553,825 B1 4/2003 Boyd
6,591,471 B1 7/2003 Hollingsworth et al.
6,595,288 B2 7/2003 Mosing et al.
6,622,796 B1 9/2003 Pietras
6,637,526 B2 10/2003 Juhasz et al.
6,651,737 B2 11/2003 Bouligny
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,725,938 B1 4/2004 Pietras
6,725,949 B2 4/2004 Seneviratne
6,732,822 B2 5/2004 Slack et al.
6,742,584 B1 6/2004 Appleton
6,742,596 B2 6/2004 Haugen
6,832,656 B2 12/2004 Fournier, Jr. et al.
6,832,658 B2 12/2004 Keast
6,840,322 B2 1/2005 Haynes
6,892,835 B2 5/2005 Shahin et al.
6,907,934 B2 6/2005 Kauffman et al.
6,938,697 B2 9/2005 Haugen
6,976,298 B1 12/2005 Pietras
7,004,259 B2 2/2006 Pietras
7,028,586 B2 4/2006 Robichaux
7,073,598 B2 7/2006 Haugen
7,090,021 B2 * 8/2006 Pietras ..... 166/380
7,096,977 B2 8/2006 Juhasz et al.
7,100,698 B2 9/2006 Kracik et al.
7,107,875 B2 9/2006 Haugen et al.
7,117,938 B2 10/2006 Hamilton et al.
7,140,445 B2 11/2006 Shahin et al.
7,188,686 B2 3/2007 Folk et al.
7,213,656 B2 5/2007 Pietras
7,325,610 B2 2/2008 Giroux et al.
2001/0042625 A1 11/2001 Appleton
2002/0029878 A1 3/2002 Victor
2002/0108748 A1 8/2002 Keyes
2002/0170720 A1 11/2002 Haugen
2003/0155159 A1 8/2003 Slack et al.
2003/0164276 A1 9/2003 Snider et al.
2003/0173073 A1 9/2003 Snider et al.
2003/0221519 A1 12/2003 Haugen et al.
2004/0003490 A1 1/2004 Shahin et al.

| | | | |
|---|---|---|---|
| 2004/0069500 | A1 | 4/2004 | Haugen |
| 2004/0144547 | A1 | 7/2004 | Koithan et al. |
| 2004/0173358 | A1 | 9/2004 | Haugen |
| 2004/0216924 | A1 | 11/2004 | Pietras et al. |
| 2004/0251050 | A1 | 12/2004 | Shahin et al. |
| 2004/0251055 | A1 | 12/2004 | Shahin et al. |
| 2005/0000691 | A1 | 1/2005 | Giroux et al. |
| 2005/0051343 | A1 | 3/2005 | Pietras et al. |
| 2005/0096846 | A1 | 5/2005 | Koithan et al. |
| 2005/0098352 | A1 | 5/2005 | Beierbach et al. |
| 2006/0000600 | A1 | 1/2006 | Pietras |
| 2006/0124353 | A1 | 6/2006 | Juhasz et al. |
| 2006/0180315 | A1 | 8/2006 | Shahin et al. |
| 2007/0000668 | A1 | 1/2007 | Christensen |

FOREIGN PATENT DOCUMENTS

| | | |
|---|---|---|
| DE | 3 523 221 | 2/1987 |
| EP | 0 087 373 | 8/1983 |
| EP | 0 162 000 | 11/1985 |
| EP | 0 171 144 | 2/1986 |
| EP | 0 285 386 | 10/1988 |
| EP | 0 474 481 | 3/1992 |
| EP | 0 479 583 | 4/1992 |
| EP | 0 525 247 | 2/1993 |
| EP | 0 589 823 | 3/1994 |
| EP | 1148206 | 10/2001 |
| EP | 1 256 691 | 11/2002 |
| GB | 1 469 661 | 4/1977 |
| GB | 2 053 088 | 2/1981 |
| GB | 2 201 912 | 9/1988 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 345 074 | 6/2000 |
| GB | 2 357 530 | 6/2001 |
| JP | 2001/173349 | 6/2001 |
| WO | WO 90-06418 | 6/1990 |
| WO | WO 92-18743 | 10/1992 |
| WO | WO 93-07358 | 4/1993 |
| WO | WO 95-10686 | 4/1995 |
| WO | WO 96-18799 | 6/1996 |
| WO | WO 97-08418 | 3/1997 |
| WO | WO 98-05844 | 2/1998 |
| WO | WO 98-11322 | 3/1998 |
| WO | WO 98-32948 | 7/1998 |
| WO | WO 99-11902 | 3/1999 |
| WO | WO 99-41485 | 8/1999 |
| WO | WO 99-58810 | 11/1999 |
| WO | WO 00-08293 | 2/2000 |
| WO | WO 00-09853 | 2/2000 |
| WO | WO 00-11309 | 3/2000 |
| WO | WO 00-11310 | 3/2000 |
| WO | WO 00-11311 | 3/2000 |
| WO | WO 00-39429 | 7/2000 |
| WO | WO 00-39430 | 7/2000 |
| WO | WO 00-50730 | 8/2000 |
| WO | WO 01-12946 | 2/2001 |
| WO | WO 01-33033 | 5/2001 |
| WO | WO 01-94738 | 12/2001 |
| WO | WO 2004-022903 | 3/2004 |
| WO | WO 2005/090740 | 9/2005 |

OTHER PUBLICATIONS

Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Laurent, et al., "Hydraulic Rig Supports Casing Drilling," World Oil, Sep. 1999, pp. 61-68.

Shepard, et al., "Casing Drilling: An Emerging Technology," IADC/SPE Paper 67731, SPE/IADC Drilling Conference, Feb. 27-Mar. 1, 2001, pp. 1-13.

Warren, et al., "Casing Drilling Technology Moves To More Challenging Application," AADE Paper 01-NC-HO-32, AADE National Drilling Conference, Mar. 27-29, 2001, pp. 1-10.

Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.

Vincent, et al., "Liner And Casing Drilling—Case Histories And Technology," Paper WOCD-0307-02, World Oil Casing Drilling Technical Conference, Mar. 6-7, 2003, pp. 1-20.

Tessari, et al., "Retrievable Tools Provide Flexibility for Casing Drilling," Paper No. WOCD-0306-01, World Oil Casing Drilling Technical Conference, 2003, pp. 1-11.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Coiled Tubing Handbook, World Oil, Gulf Publishing Company, 1993.

Bickford L Dennis and Mark J. Mabile, Casing Drilling Rig Selection For Stratton Field, Texas, World Oil, vol. 226, No. 3, Mar. 2005.

G H. Kamphorst, G. L. Van Wechem, W. Boom, D. Bottger, And K. Koch, Casing Running Tool, SPE/IADC 52770.

* cited by examiner

APPARATUS FOR CONNECTING TUBULARS USING A TOP DRIVE

CROSS-REFERENCE TO RELATED APPLICATIONS

This application is a continuation of U.S. patent application Ser. No. 10/801,289, filed Mar. 16, 2004, now U.S. Pat. No. 7,090,021, which claims benefit of U.S. patent application Ser. No. 09/762,606, filed May 21, 2001, now U.S. Pat. No. 6,705,405, which is the National Stage of International Application No. PCT/GB99/02708, filed Aug. 16, 1999, which claims benefit of Great Britain Patent Application No. GB9818360.1, filed Aug. 24, 1998. Each of the aforementioned related patent applications is herein incorporated by reference.

BACKGROUND OF THE INVENTION

Field of the Invention

This invention relates to an apparatus for facilitating the connection of tubulars using a top drive and is more particularly, but not exclusively, intended for facilitating the connection of a section or stand of casing to a string of casing.

SUMMARY OF THE INVENTION

In the construction of oil or gas wells it is usually necessary to line the borehole with a string of tubulars known as a casing. Because of the length of the casing required, sections or stands of say two sections of casing are progressively added to the string as it is lowered into the well from a drilling platform. In particular, when it is desired to add a section or stand of casing the string is usually restrained from falling into the well by applying the slips of a spider located in the floor of the drilling platform. The new section or stand of casing is then moved from a rack to the well centre above the spider. The threaded pin of the section or stand of casing to be connected is then located over the threaded box of the casing in the well and the connection is made up by rotation there between. An elevator is then connected to the top of the new section or stand and the whole casing string lifted slightly to enable the slips of the spider to be released. The whole casing string is then lowered until the top of the section is adjacent the spider whereupon the slips of the spider are re-applied, the elevator disconnected and the process repeated.

It is common practice to use a power tong to torque the connection up to a predetermined torque in order to make the connection. The power tong is located on a platform, either on rails, or hung from a derrick on a chain. However, it has recently been proposed to use a top drive for making such connection. The normal use of such a top drive may be the driving of a drill string.

A problem associated with using a top drive for rotating tubulars in order to obtain a connection between tubulars is that some top drives are not specifically designed for rotating tubulars are not able to rotate at the correct speed or have non standard rotors.

According to the present invention there is provided an apparatus for facilitating the connection of tubulars using a top drive, said apparatus comprising a motor for rotating a tool for drivingly engaging a tubular, and means for connecting said motor to said top drive, the apparatus being such that, in use, said motor can rotate one tubular with respect to another to connect said tubulars.

Other features of the invention are set out in Claims 2 et seq.

BRIEF DESCRIPTION OF THE DRAWINGS

For a better understanding of the present invention and in order to show how the same may be carried into effect reference will now be made, by way of example, to the accompanying drawings, in which.

DETAILED DESCRIPTION OF THE PREFERRED EMBODIMENT

Figure 1:
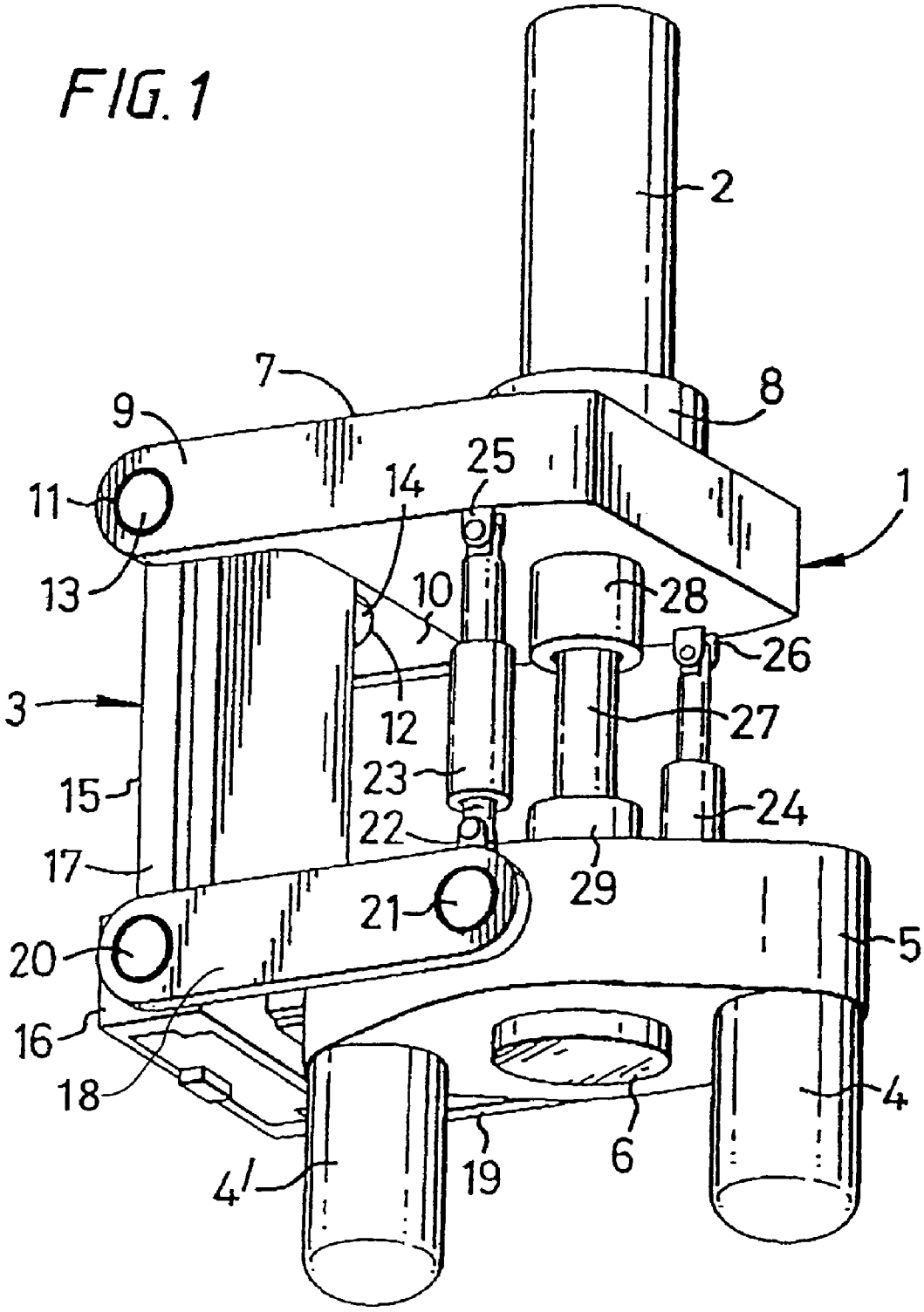
FIG. 1 is a front perspective view of an apparatus in accordance with the present invention.

Referring to FIG. 1 there is shown an apparatus which is generally identified by reference numeral 1.

The apparatus 1 comprises a connecting tubular 2, a suspension unit 3 and a hydraulic motor 4 and 4'. The hydraulic motor 4,4' has a stator 5 and a rotor 6 and is driven by a supply of pressurised hydraulic fluid (the fluid supply lines are not illustrated in the Figures). The suspension unit 3 suspends the hydraulic motor 4,4' from the connecting tubular 2.

The suspension unit 3 comprises a plate 7 which is fixed to the connecting tubular 2 by a collar 8. The plate 7 has two projections 9 and 10 which have holes 11 and 12 for accommodating axles 13 and 14, which arc rotationally disposed therein. The axles 13 and 14 are integral with a rigid body 15. A slider 16 is arranged on runners 17 and (not shown) on the rigid body 15. Arms 18 and 19 are connected at one end to the slider 16 via spherical bearings 20 and at the other end to each side of the stator 5 via spherical bearings 21 and 21'. The arms 18 and 19 are provided with lugs 22 and 22' to which one end of a piston and cylinder 23, 24 is attached and are movable thereabout. The other end of each piston and cylinder 23, 24 is attached to lugs 25, 26 respectively and is movable thereabout. A mud pipe 27 is provided between the plate 7 and the stator 5 for carrying mud to the inside of a tubular therebelow. The mud pipe 27 comprises curved outer surfaces at both ends (not shown) which are located in corresponding recesses in cylindrical sections 28, 29, thus allowing a ball and socket type movement between the plate 7 and the stator 5.

Figure 2:
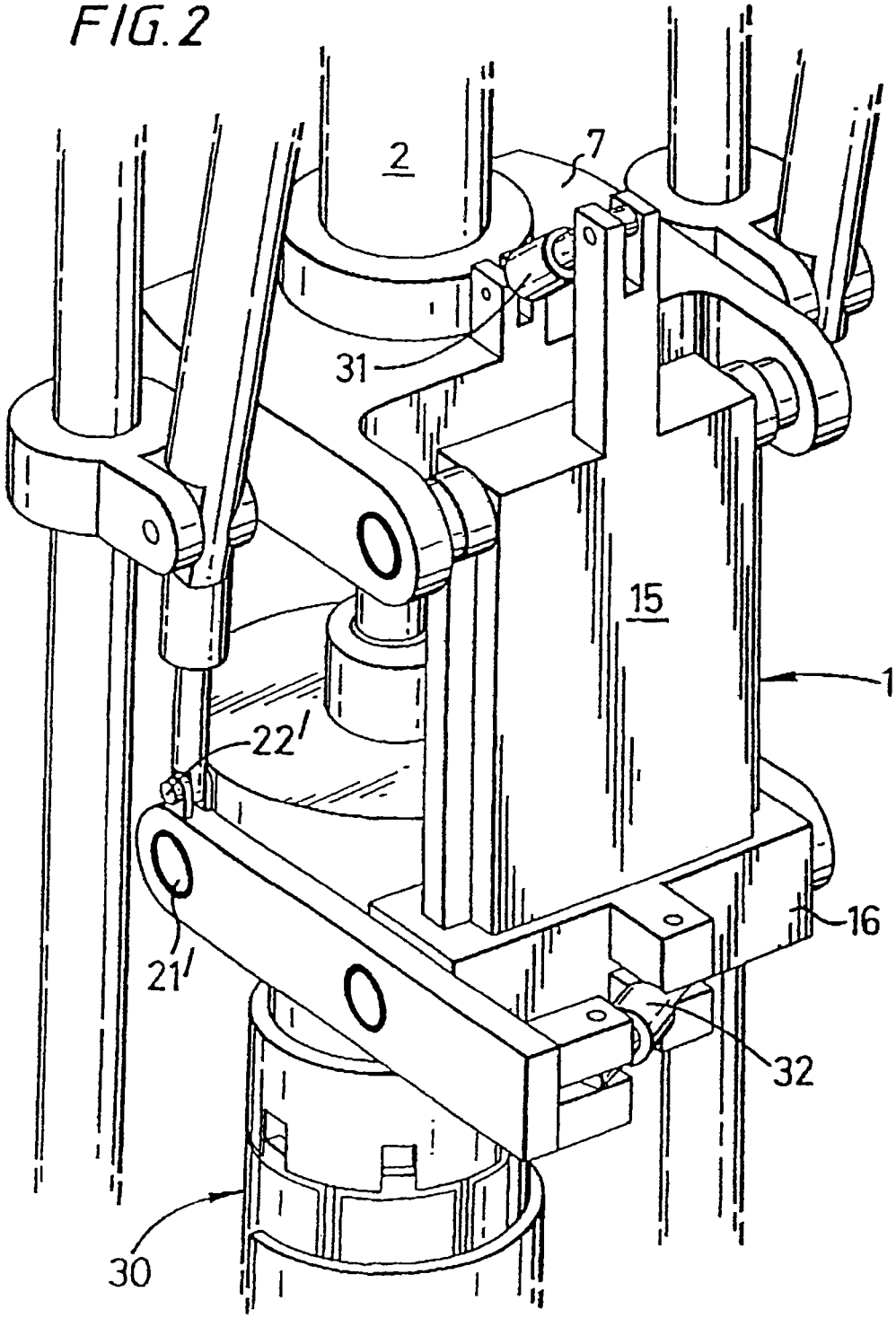
FIG. 2 is a rear perspective view of the apparatus of FIG. 1 in use.

Referring to FIG. 2, the apparatus 1 is suspended from a top drive (not shown) via connecting shaft 2. A tool 30 for engaging with a tubular is suspended from beneath the rotor 6 of the hydraulic motor 4. Such a tool may be arranged to be inserted into the upper end of the tubular, with gripping elements of the tool being radially displaceable for engagement with the inner wall of the tubular so as to secure the tubular to the tool.

In use, a tubular (not shown) to be connected to a tubular string held in a spider (not shown) is located over the tool 30. The tool 30 grips the tubular. The apparatus 1 and the tubular are lowered by moving the top drive so that the tubular is in close proximity with the tubular string held in the spider. However, due to amongst other things manufacturing tolerances in the tubulars, the tubular often does not align perfectly with the tubular held in the spider. The suspension unit 3 allows minor vertical and horizontal movements to be made by using alignment pistons 31 and 32 for horizontal movements, and piston and cylinders 23 and 24 for vertical movements. The alignment piston 31 acts between the rigid body 15 and the plate 7. The alignment piston 32 acts between the slider 16 and the arm 19. The alignment pistons 31 and 32 and pistons and cylinders 23, 25 are actuated by hydraulic or pneumatic means and controlled from a remote control device.

The piston and cylinders 23, 24 are hydraulically operable. It is envisaged however, that the piston and cylinders 23, 24 may be of the pneumatic compensating type, i.e. their internal pressure may be adjusted to compensate for the weight of the tubular so that movement of the tubular may be conducted with minimal force. This can conveniently be achieved by introducing pneumatic fluid into the piston and cylinder 23, 24 and adjusting the pressure therein.

Once the tubulars are aligned, the hydraulic motor 4 and 4' rotate the tubular via 15 gearing in the stator 5 thereby making up the severed connection. During connection the compensating piston and cylinders 23, 24 expand to accommodate the movement of the upper tubular. The alignment pistons 31 and 32 can then be used to move the top of the tubular into alignment with the top drive. If necessary, final torquing can be conducted by the top drive at this stage, via rotation of the pipe 27, and the main elevator can also be swung onto and connected to the tubular prior to releasing the slips in the spider and lowering the casing string. It will be appreciated that the suspension unit 3 effectively provides an adapter for connecting a top drive to the tubular engaging tool 30.

The invention claimed is:

1. A method of facilitating making of a connection between an upper tubular and a lower tubular, comprising:

engaging the upper tubular with a tubular engagement tool attached to a suspension unit;

engaging a lower end of the upper tubular with an upper end of the lower tubular;

rotating the upper tubular via the tubular engagement tool, thereby threading the tubulars to form the connection;

torquing the connection via the tubular engagement tool; and compensating for movement of the upper tubular with the suspension unit during the threading.

2. The method of claim 1, wherein the upper tubular is rotated using a motor mounted on the suspension unit.

3. The method of claim 2, further comprising rotating the upper tubular using a top drive.

4. The method of claim 1, further comprising adjusting the suspension unit to move the upper tubular in at least two planes.

5. The method of claim 1, wherein compensating for movement of the upper tubular comprises pneumatically compensating via at least one piston and cylinder arrangement.

6. The method of claim 1, wherein compensating for movement of the upper tubular comprises compensating via at least one piston and cylinder arrangement.

7. The method of claim 1, wherein the tubular engagement tool includes at least one gripping element displaceable in a radial direction for engagement with a wall of the upper tubular during engaging the upper tubular.

8. The method of claim 1, further comprising rotating the upper tubular using a top drive.

9. A method of facilitating making of a connection between an upper tubular and a lower tubular, comprising:

engaging the upper tubular with a gripping assembly having at least one radially displaceable element for gripping the upper tubular, wherein the gripping assembly is connected to a suspension unit;

compensating for weight of the upper tubular to accommodate movement of the upper tubular while engaged by the gripping assembly;

engaging a lower end of the upper tubular with an upper end of the lower tubular to form the connection therebetween; and delivering torque to the upper tubular via the gripping assembly.

10. The method of claim 9, wherein the torque is generated from a motor mounted to the suspension unit.

11. The method of claim 9, wherein engaging the lower end of the upper tubular with the upper end of the lower tubular includes rotating the upper tubular, thereby threading the tubulars together.

12. The method of claim 11, further comprising compensating for movement of the upper tubular with the suspension unit during the threading.

13. The method of claim 9, further comprising adjusting the suspension unit to move the upper tubular in at least two planes.

14. The method of claim 9, wherein compensating for weight of the upper tubular comprises compensating via at least one piston and cylinder arrangement.

15. The method of claim 9, wherein compensating for weight of the upper tubular is pneumatic.

16. An apparatus for making a connection between an upper tubular and a lower tubular, comprising:

a tubular engagement tool for gripping the upper tubular, wherein the tubular engagement tool includes at least one gripping element displaceable in a radial direction for engagement with a wall of the upper tubular in an engaged position; and a suspension unit connected to the tubular engagement tool, the suspension unit having a motor for rotating the tubular engagement tool and a compensation portion, wherein, with the tubular engagement tool in the engaged position, the upper tubular is rotatable by the motor and is, relative to the lower tubular, movable along with the tubular engagement tool by operation of the compensation portion to compensate for movement of the upper tubular during making of the connection to the lower tubular.

17. The apparatus of claim 16, further comprising a top drive connected to the suspension unit.

18. The apparatus of claim 17, wherein the top drive is capable of rotating the tubular engagement tool.

19. The apparatus of claim 16, wherein the suspension unit is adapted to move the tubular engagement tool in the axial direction to compensate for movement of the upper tubular during make up.

20. The apparatus of claim 16, wherein the suspension unit is adapted to move the upper tubular in at least two planes.

21. The apparatus of claim 16, wherein the compensation portion comprises at least one piston and cylinder arrangement.

22. The apparatus of claim 16, further comprising a mud pipe for carrying mud to the tubulars.

23. The apparatus of claim 16, wherein the at least one gripping element is displaceable for engagement with an inner wall of the upper tubular in the engaged position.

* * * * *